United States Patent [19]

Spicer

[11] 4,116,515

[45] Sep. 26, 1978

[54] SPRING ACTUATED CONTACT FOR HIGH VOLTAGE BUSHING

[75] Inventor: Bruce G. Spicer, Waukesha, Wis.

[73] Assignee: RTE Corporation, Waukesha, Wis.

[21] Appl. No.: 743,944

[22] Filed: Nov. 22, 1976

[51] Int. Cl.[2] ..... H01R 11/30

[52] U.S. Cl. ..... 339/12 R; 200/149 A; 335/192; 339/111

[58] Field of Search ..... 339/111, 12; 200/144 C, 200/148 R, 149 A, 147 R; 361/2, 3; 335/192

[56] References Cited

U.S. PATENT DOCUMENTS

| | | | |
|---|---|---|---|
| 3,586,802 | 6/1971 | Nichols et al. | 200/149 A |
| 3,711,800 | 1/1973 | Clinton | 335/192 |
| 3,945,699 | 3/1976 | Westrom | 339/111 |
| 3,957,332 | 5/1976 | Lambert | 339/111 |

*Primary Examiner*—Harold Broome
*Attorney, Agent, or Firm*—Ronald E. Barry

[57] ABSTRACT

A high voltage bushing having a bore contact mounted for axial movement within the bushing housing, the bore contact being biased for movement into engagement with a rod contact and a magnetically responsive trip mechanism releasably engaging the bore contact and being responsive to a magnetic field produced under fault current conditions to release the bore contact for movement into engagement with the rod contact.

11 Claims, 5 Drawing Figures

SPRING ACTUATED CONTACT FOR HIGH VOLTAGE BUSHING

BACKGROUND OF THE INVENTION

High voltage terminators have been developed which are capable of performing load make, load break and fault close operations in service. Since the introduction of these terminators into distribution systems, the load densities have increased resulting in stiffer lines with more fault current and longer back-up clearing times available. This has necessitated an increase in the fault close requirement. A number of devices have been developed which utilize the increase in gas pressure produced by the prestrike arc to move the bore contact rapidly into engagement with the terminator.

SUMMARY OF THE INVENTION

The bushing according to the present invention utilizes an independent motive force for moving the bore contact in the event of a high fault current condition. This motivating force is stored in a preloaded spring mounted within the bushing in a position to bias the bore contact toward the rod contact in the terminator. The spring force is released by the magnetic field produced in the bushing under fault current conditions. The use of the magnetic field minimizes the amount of energy required to release the bore contact for movement toward the terminator and thus provides faster close-in between the rod and bore contacts due to the stored spring force rather than relying on the contact closing energy to move the bore contact.

DRAWINGS

DESCRIPTION OF THE INVENTION

Figure 1:
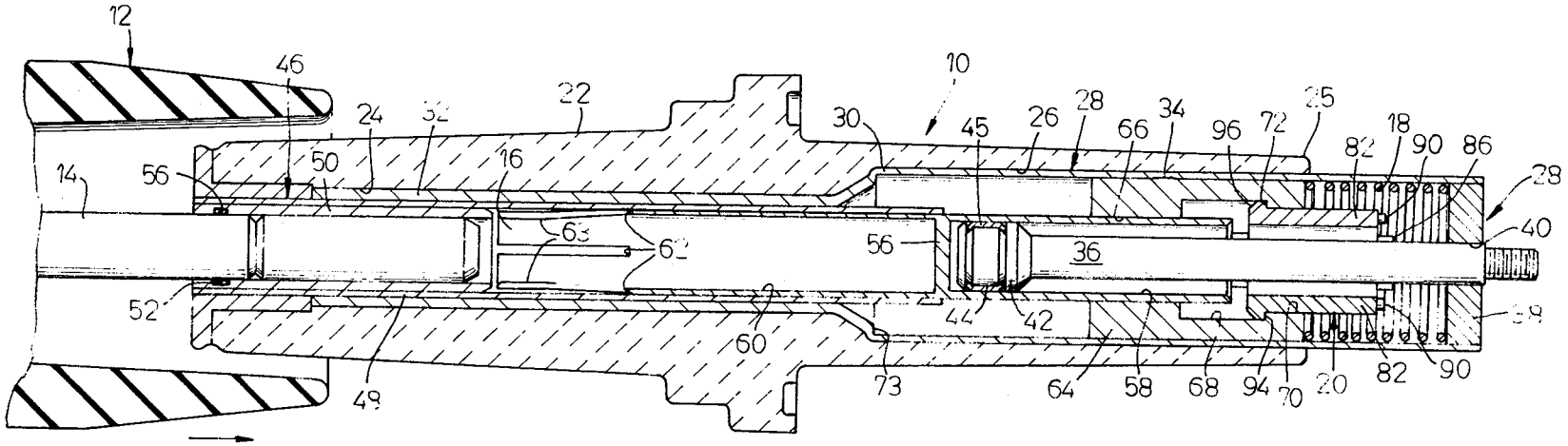
FIG. 1 is a side view in section of the high voltage bushing according to the invention.

The high voltage bushing 10 according to the invention is used in combination with a terminator 12 having an elongated rod contact 14. The bushing 10 includes an elongated bore contact 16 that is adapted to telescopically receive the rod contact 14 to form a load break combination. The bore contact is free to move within the bushing and is biased by means of a spring 18 to move rapidly under fault current conditions. The bore contact is held or restrained from movement by means of a magnetic trip mechanism 20 which responds to a predetermined fault current condition within the bushing on load make to release the bore contact and allow the spring 18 to rapidly move the bore contact into engagement with the rod contact 14.

More particularly, the bushing 10 includes an insulating housing 22 formed of an insulating material such as a ceramic or epoxy. The housing includes an axial bore 24 having an enlarged bore 26 at one end that terminates at a tapered shoulder 25.

A conductive assembly 28 is mounted within the bore 24 which is adapted to be connected to an electrical device. The conductive assembly 28 includes a cylindrical conductive tube 30 having a reduced diameter section 52 which is received in the bore and an enlarged section 34 which is received within the bore 26. A current carrying conductor 36 is supported within the enlarged section 34 by means of a conductive end cap 38. In this regard, the conductor 34 is inserted within a bore 40 in the end cap 38 and secured therein by braising or welding. An enlarged head 42 is provided at the other end of the conductor 36 and is provided with an annular recess 44. Means are provided in the annular recess 44 in the form of a contact ring 45 for electrically engaging the bore contact 16 as described hereinafter.

The conductor 36 is connected to the rod contact 14 by means of a contact-snuffer assembly 46 provided within the reduced diameter section 32 of the conductive tube 30. The contact-snuffer assembly includes an insulating tube 48 which is slidably received within the section 32. An arc quenching sleeve 50 is provided at the open end of the tube 48. The bore contact 16 is mounted in the other end of the tube 48. An O-ring seal 54 is provided with an annular groove 52 in sleeve 50 to sealingly engage the rod contact 14.

The bore contact 16 is in the form of a hollow cylindrical member having a partition 56 intermediate the ends thereof to form a blind bore 58 at one end and a blind bore 60 at the other end. The blind bore 58 has a diameter slightly greater than the enlarged section 42 provided on the conductor 36. The blind bore 60 includes a number of slots 62 around the open end which define a number of flexible contacts 63.

The contact-snuffer assembly 46 is supported within the housing 22 by means of the reduced diameter section 32 and a hollow cylindrical support member 64. The outer diameter of the support member 64 should be sized to provide a clearance fit with the inner diameter of the bore in the enlarged section 34 of the conductive tube 30 and an inner bore 66 having a diameter substantially equal to the diameter of the contact 16. The member 64 includes an enlarged diameter opening 68 and a bore 70 having a diameter slightly smaller than the diameter of the bore 68 to form a ledge or shoulder 72. A key slot 86 is provided in the bore 70 to provide clearance for the trip mechanism 20. The conductor 16 is inserted within the bore 66 and is bonded thereto so that the member 64 moves with the contact-snuffer assembly 46.

The contact-snuffer assembly 46 is biased by means of the spring 18 which is positioned between the member 64 and the end cap 38 to move outwardly from the end of the bushing 10. The travel or stroke of the bore contact is limited to the distance between the end of the member 64 and a shoulder 75 provided at the end of the enlarged section 34.

Figure 4:
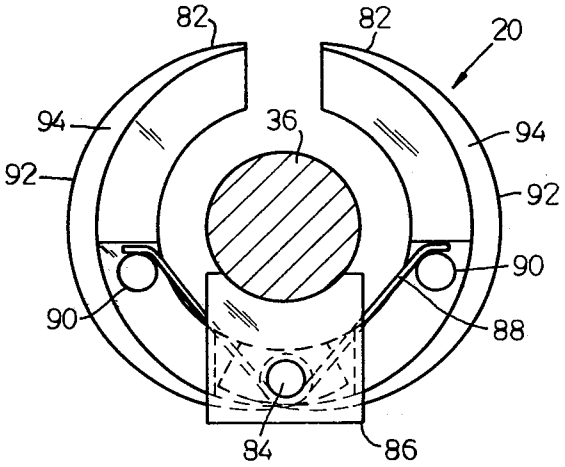
FIG. 4 is an end view taken on line 4—4 of FIG. 3 showing the magnetic trip mechanism in open holding position.
Figure 5:
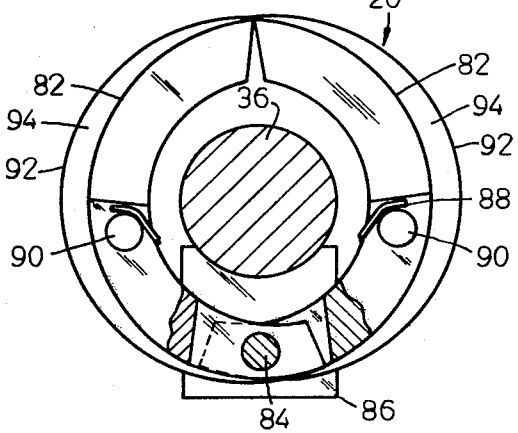
FIG. 5 is an end view similar to FIG. 4 showing the magnetic trip mechanism in the closed release position with parts broken away for clarity.
Figure 3:
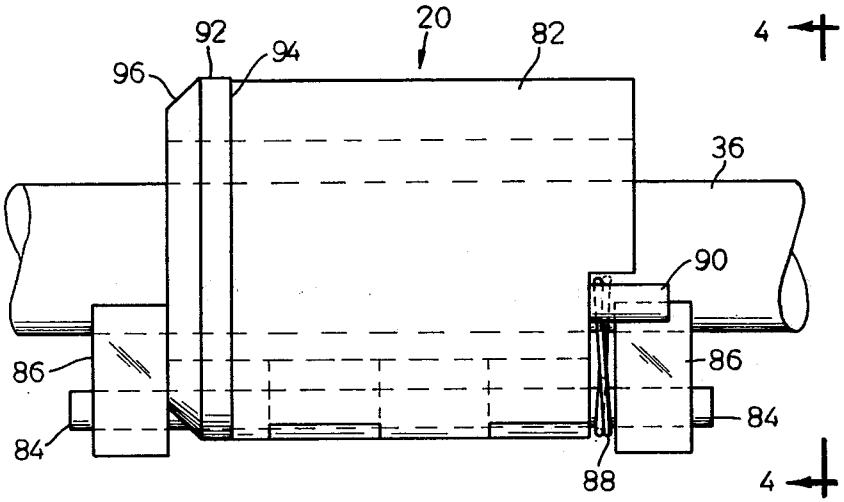
FIG. 3 is a side view of the magnetic trip mechanism.

Means are provided on the conductor 36 for releasably engaging the assembly 46 to restrain the movement of the bore contact until a fault current condition exists in the bushing. Such means is in the form of a magnetic trip mechanism 20. Referring to FIGS. 3, 4 and 5, the magnetic trip mechanism 20 includes a pair of arcuate metallic members 82 which are pivotally mounted on a pivot pin 84. The pin 84 is supported on the conductor 36 by means of a pair of brackets 86 braised or welded to the conductor 36. The members 82 are biased outwardly by means of a reset spring 88 mounted on the pivot pin 84. The ends of the spring 88 overlap pins 90 provided on the members 82. A flange 92 is provided at one end of each of the members 82 which forms a shoulder 94 that engages the ledge 72 on the member 64. The end of the flange 92 is bevelled at 96 to cam the members 82 inwardly on insertion of the magnetic trip mechanism 20 into the bore 70 of the member 64.

The trip mechanism 20 operates in response to a fault current in the conductor 36 which produces a magnetic field of sufficient force to pull the members 82 toward the conductor against the bias of the spring 88. Under fault current conditions, the build up of magnetic force is substantially instantaneous with the production of the prestrike arc on close-in of the rod 14 with the bore contact 16. If the magnetic field produced under fault current conditions is of sufficient magnitude to move the members 82 toward the conductor and release the member 64, the bias force of the spring 18 will instantly accelerate the bore contact to move rapidly toward the rod contact 14.

Figure 2:
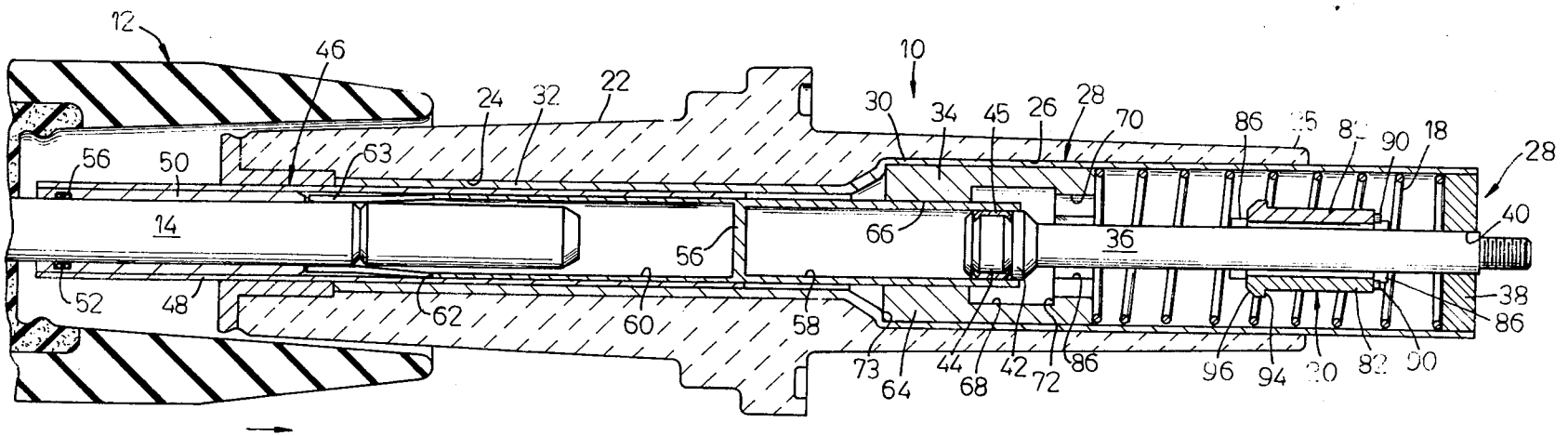
FIG. 2 is a view in section of the high voltage bushing showing the bore contact in the operative position under fault current conditions.

In operation and referring to FIGS. 1 and 2, the terminator 12 is moved toward the bushing 10 to move the rod contact 14 into the contact-snuffer assembly 46. If a fault current condition exists, a prestrike arc will develop between the rod contact 14 and bore contact 16. A magnetic field will be set up around conductor 36 drawing the members 82 toward the conductor. When the ledge 94 on the members 82 clears the shoulder 72 on the support member 64, the spring 18 will instantly accelerate the contact-snuffer assembly 46 toward the rod contact 14. When the rod contact 14 engages the bore contact 16, the prestrike arc will be extinguished. Further movement of the terminator 12 toward the bushing 10 will push the contact-snuffer assembly back into the bushing housing 25.

The embodiments of the invention in which an exclusive property or privilege is claimed are defined as follows:

1. A high voltage bushing comprising:

a housing, an electrical conductor extending into said housing, an electrical contact operatively connected to said conductor and mounted for movement within said housing from a first position to a second position, first means for biasing said contact to move within said housing from the first position to the second position, a magnetically responsive member moveably mounted in said housing and located in a position to respond to the magnetic field produced by current flow through said conductor, said magnetic member releasably holding said contact in the first position in said housing, and second means biasing said member toward a position to hold said contact in the first position, said magnetic member being responsive to a fault current for releasing said contact for movement by said first biasing means to the second position.

2. The bushing according to claim 1 wherein said first biasing means includes a spring.

3. The bushing according to claim 1 wherein said contact comprises a bore contact.

4. The bushing according to claim 1 wherein said magnetic member is mounted for pivotal movement within the housing in response to the magnetic force produced by a fault current in said conductor.

5. The bushing according to claim 1 wherein said magnetic member is pivotally mounted on the conductor and said second biasing means is mounted to bias said member away from said conductor into locking engagement with said contact, said member responding to the magnetic field produced around the conductor under a fault current condition to move toward the conductor to release the contact.

6. An electric bushing comprising:

a housing, a conductor in said housing, contact means slidably mounted within said housing for movement from an open position toward a closed position, spring means in said housing for moving said contact means from said open position toward said closed position, means in said housing holding said contact means in said open position, said holding means being responsive to a fault current condition in said conductor for releasing said holding means whereby said spring means will move said contact means toward said closed position.

7. The bushing according to claim 6 wherein said holding means includes a pair of magnetic members releasably engaging said contact means and being responsive to a magnetic field produced in said conductor under fault current conditions to release the contact means.

8. In a high voltage circuit:

a rod and a bore contact rod coaxially movable for telescopic engagement, means biasing said bore contact toward said rod contact, and means releasably engaging said bore contact to prevent movement due to the bias force of said biasing means, said engaging means responding to a prestrike arc of a predetermined magnitude to release said engaging means whereby said biasing means rapidly moves said contacts together to extinguish said arc.

9. In combination, a pair of relatively movable high voltage contacts that are adapted to be moved from an unengaged, non-conducting position to an engaged, conducting position and spring means for causing rapid engagement of said contacts when an electric arc is formed between said contacts comprising:

means for supporting one of said contacts for movement toward the other of said contacts, a spring positioned to bias said one of said contacts into engagement with the other of said contacts, and magnetic means releasably engaging said one of said contacts and being responsive to a prestrike arc for releasing said one of said contacts whereby said one of said contacts is free to move under the influence of said spring rapidly into engagement with the other of said contacts.

10. A high voltage bushing comprising a housing, a conductor mounted within said housing, a bore contact slidably mounted on said conductor for movement from a first position to a second position, spring means positioned to move said bore contact with respect to said conductor, and magnetic means mounted on said conductor releasably engaging said bore contact, said magnetic means being responsive to a fault current through said conductor to release said contact whereby said bore contact will move rapidly with respect to said conductor.

11. A high voltage bushing comprising a housing, an electrical contact mounted for movement within said housing from a first position to a second position, means for biasing said contact to move within said housing from the first position to the second position, a fixed conductor within said housing operatively engaging said electrical contact, and magnetic means for holding said contact in the first position in said housing, said magnetic means including a pair of members pivotally mounted on said fixed conductor and a spring mounted to bias said members away from said conductor into locking engagement with said contact, said members responding to the magnetic field produced around the conductor under a fault current condition to move toward the conductor to release the contact.

* * * * *